US010483695B2

(12) United States Patent
Cheng et al.

(10) Patent No.: US 10,483,695 B2
(45) Date of Patent: Nov. 19, 2019

(54) ELECTRICAL CONNECTOR TRANSMITTING HIGH FREQUENCY SIGNALS

(71) Applicant: FOXCONN INTERCONNECT TECHNOLOGY LIMITED, Grand Cayman (KY)

(72) Inventors: Shan-Yong Cheng, New Taipei (TW); Tzu-Yao Hwang, New Taipei (TW); Ke-Hao Chen, New Taipei (TW); Kuo-Wei Chang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/134,928

(22) Filed: Sep. 18, 2018

(65) Prior Publication Data

US 2019/0089098 A1 Mar. 21, 2019

(30) Foreign Application Priority Data

Sep. 18, 2017 (CN) ..... 2017 1 0841375

(51) Int. Cl.

| | |
|---|---|
| ***H01R 13/6471*** | (2011.01) |
| ***H01R 4/02*** | (2006.01) |
| ***H01R 13/24*** | (2006.01) |
| ***H01R 13/422*** | (2006.01) |
| *H01R 12/70* | (2011.01) |
| *H01R 13/41* | (2006.01) |

(52) U.S. Cl.

CPC ..... *H01R 13/6471* (2013.01); *H01R 4/02* (2013.01); *H01R 13/2442* (2013.01); *H01R 13/422* (2013.01); *H01R 12/707* (2013.01); *H01R 13/41* (2013.01)

(58) Field of Classification Search

CPC .. H01R 13/6471; H01R 4/02; H01R 13/2442; H01R 13/422; H01R 13/46

USPC ..... 439/658

See application file for complete search history.

(56) References Cited

U.S. PATENT DOCUMENTS 4,354,729 A * 10/1982 Grabbe ..... H05K 7/1069 29/874

4,921,430 A * 5/1990 Matsuoka ..... H01R 13/2442 439/72

(Continued)

*Primary Examiner* — Tulsidas C Patel

*Assistant Examiner* — Peter G Leigh

(74) *Attorney, Agent, or Firm* — Wei Te Chung; Ming Chieh Chang

(57) ABSTRACT

An electrical connector includes an insulative housing with a plurality of passageways and a plurality of contacts received therein. The contact includes an upstanding section retained in the passageway with a spring am extending from an upper region of the upstanding plate and above the mating surface, and a mounting leg extending from a lower region of the upstanding plate around the mounting surface. The spring arm forms a contacting section around a free end thereof. The contact further includes an extension extending from the upstanding section and optimally above the mating surface so as to be located between the spring arm and the mating surface in the vertical direction. The extension and the spring arm are partially overlapped in the vertical direction and results in the capacitance effect therebetween, thus lowering impedance.

20 Claims, 11 Drawing Sheets

(56) References Cited

U.S. PATENT DOCUMENTS 6,572,386 B1 * 6/2003 Howell ..... H01R 13/2428 439/66
7,074,048 B2 * 7/2006 Liao ..... H01R 9/096 439/630
7,297,010 B2 * 11/2007 Tsai ..... H01R 13/2442 439/331
7,429,200 B2 * 9/2008 Lee ..... H01R 13/2442 439/862
7,563,105 B2 * 7/2009 Liu ..... H01R 13/2492 439/66
7,628,661 B2 * 12/2009 Liao ..... H01R 12/57 439/862
7,727,032 B2 * 6/2010 Szu ..... H01R 12/57 439/342
7,775,805 B2 * 8/2010 Liao ..... H01R 13/2435 439/66
7,857,632 B2 * 12/2010 Liu ..... H01R 13/2492 439/66
7,878,823 B2 * 2/2011 Fan ..... H01R 12/58 439/83
7,914,314 B2 * 3/2011 Szu ..... H01R 4/02 439/260
8,235,734 B2 * 8/2012 Ju ..... H01R 12/57 439/83
8,366,453 B2 * 2/2013 Chang ..... H01R 12/58 439/66
8,500,458 B2 * 8/2013 Chang ..... H01R 13/2435 439/66
8,814,603 B2 * 8/2014 Chang ..... H01R 24/00 439/626
8,851,904 B2 * 10/2014 Chang ..... H01R 12/71 439/607.03
2004/0067665 A1 * 4/2004 Nakano ..... H01R 12/57 439/70
2009/0269950 A1 * 10/2009 Liao ..... H01R 13/2435 439/66
2010/0029102 A1 * 2/2010 Chen ..... H01R 13/17 439/66
2010/0267257 A1 * 10/2010 Yeh ..... H01R 12/57 439/83
2011/0008979 A1 * 1/2011 Yeh ..... H01R 12/57 439/83
2011/0086558 A1 * 4/2011 Cheng ..... H01R 13/03 439/886
2011/0111638 A1 * 5/2011 Cheng ..... B23K 1/0016 439/660
2012/0028502 A1 * 2/2012 Yeh ..... H01R 12/57 439/626
2013/0237090 A1 * 9/2013 Chang ..... H01R 13/6586 439/607.01
2014/0038438 A1 * 2/2014 Chang ..... H01R 12/71 439/76.1

* cited by examiner

ELECTRICAL CONNECTOR TRANSMITTING HIGH FREQUENCY SIGNALS

BACKGROUND OF THE DISCLOSURE

1. Field of the Disclosure

The present disclosure relates to an electrical connector, and more particularly to an electrical connector transmitting high frequency signals.

2. Description of Related Arts

The electrical connector for use with the CPU (Central Processing Unit) essentially includes an insulative housing with a plurality of contacts mounted upon a printed circuit board via corresponding solder balls. To assure the required mechanical contact force between the CPU and the contact in a limited space, a cantilever arm of the contact is popularly used. Anyhow, such a cantilever arm results in relatively high impedance during the high frequency transmission.

An improved electrical connector is desired.

SUMMARY OF THE DISCLOSURE

Accordingly, an object of the present disclosure is to provide the contact used with an electrical connector with the required mechanical characters while lowering the negative effect due to high impedance and/or resonance.

To achieve the above object, an electrical connector includes an insulative housing with a plurality of passageways and a plurality of contacts received therein. The housing includes opposite mating surface and mounting surface in the vertical direction, and the passageways extend therethrough both the mating surface and the mounting surface. The contact includes an upstanding section retained in the passageway with a spring am extending from an upper region of the upstanding plate and above the mating surface, and a mounting leg extending from a lower region of the upstanding plate around the mounting surface. The spring arm forms a contacting section around a free end thereof. The contact further includes an extension extending from the upstanding section and optimally above the mating surface so as to be located between the spring arm and the mating surface in the vertical direction. The extension and the spring arm are partially overlapped in the vertical direction and results in the capacitance effect therebetween, thus lowering impedance thereof. In opposite, the extension may be applied to two sides of the spring arm toward the upstanding section for resulting in the capacitance effect.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
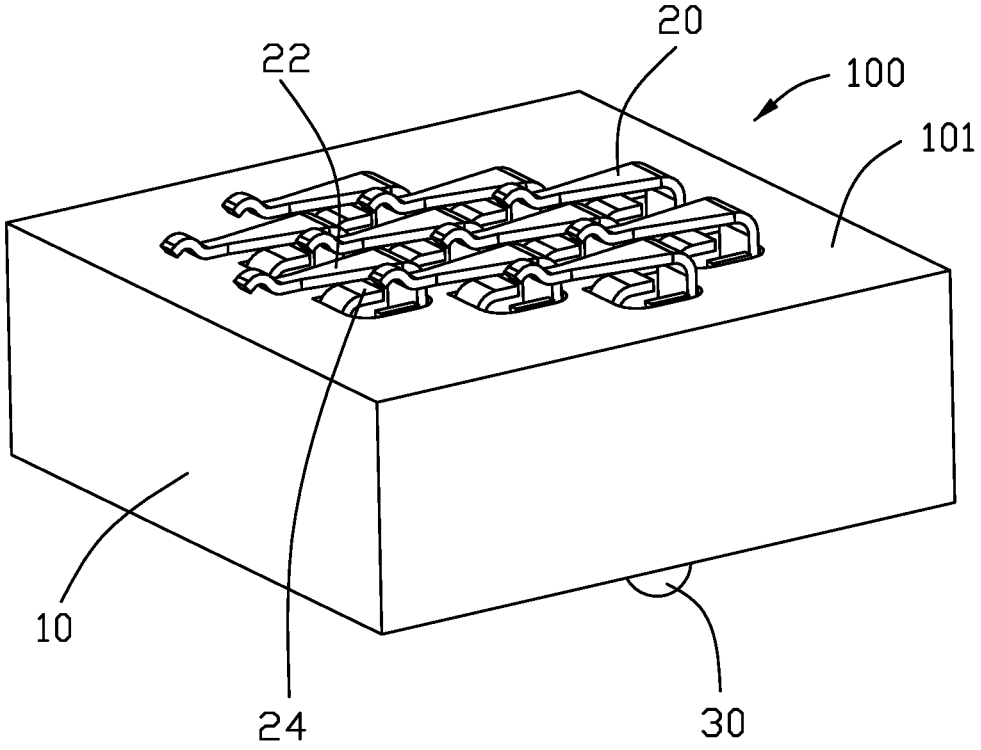
FIG. 1 is a perspective view of the electrical connector according to a first embodiment of the invention.
Figure 2:
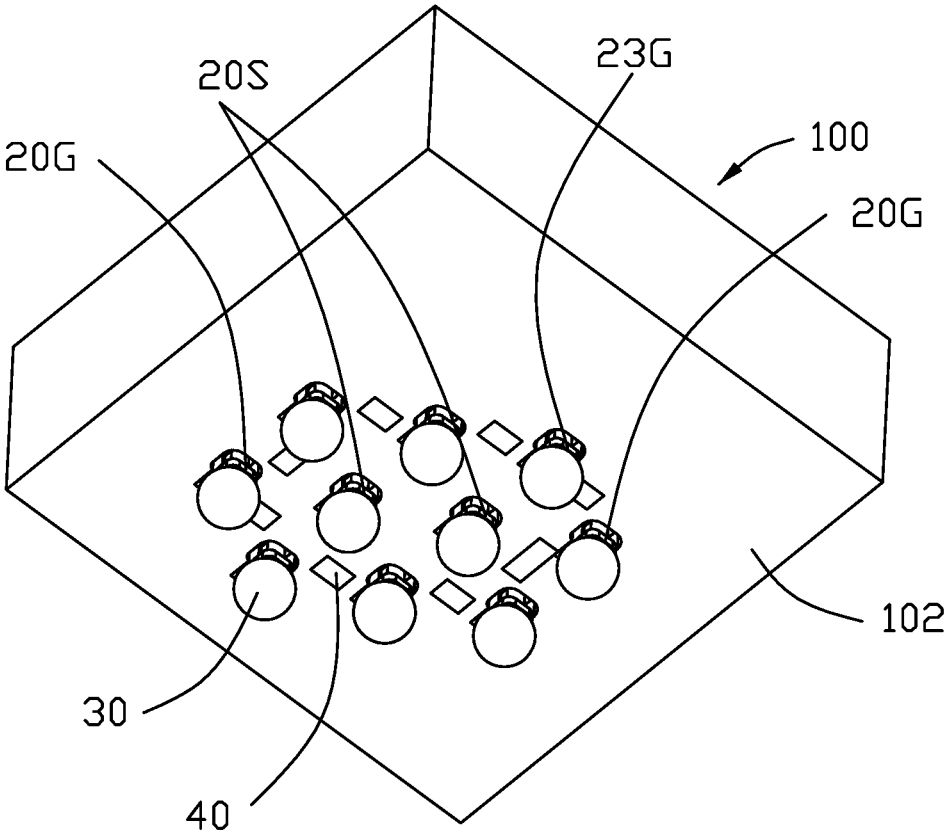
FIG. 2 is another perspective view of the electrical connector of FIG. 1.
Figure 3:
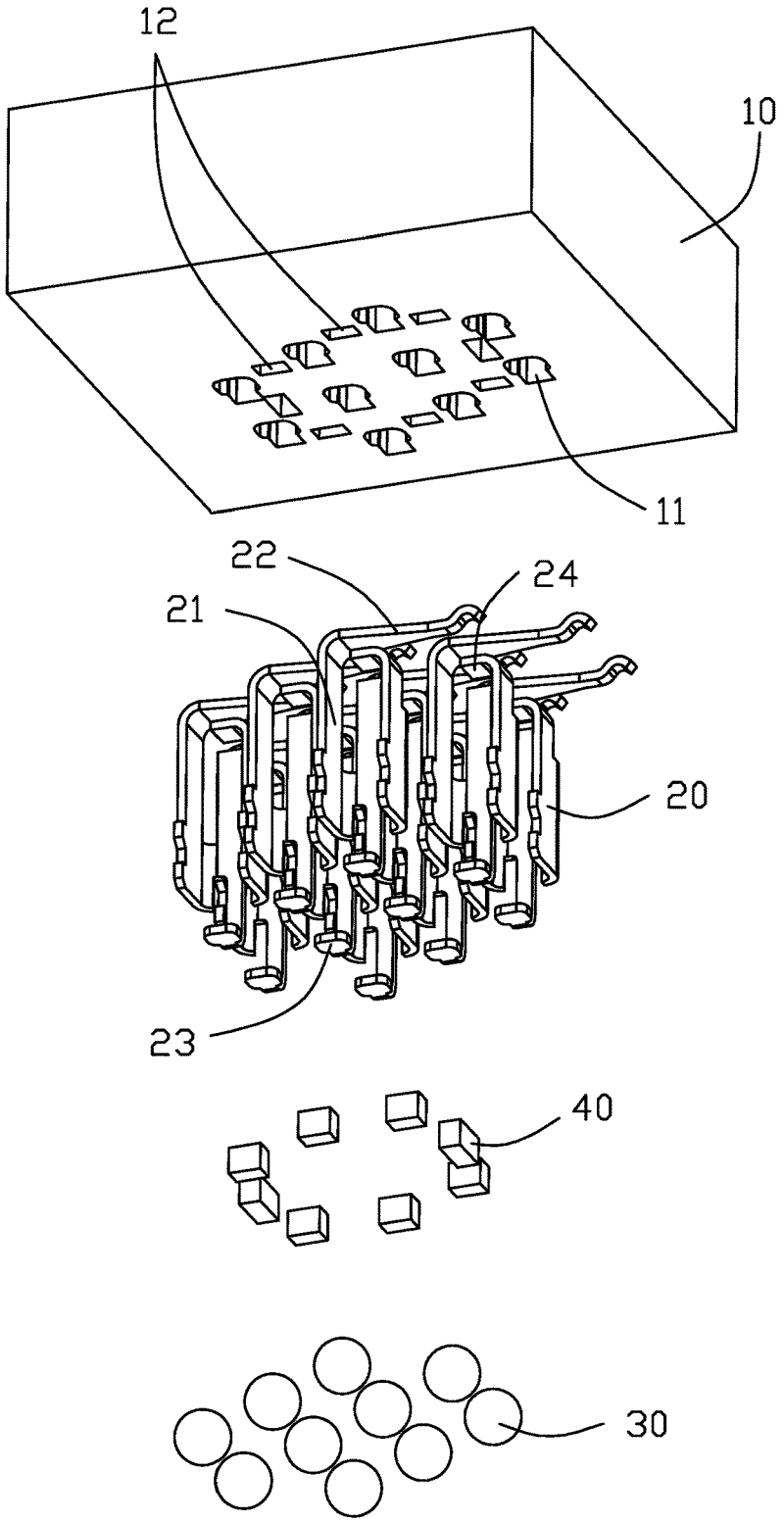
FIG. 3 is exploded perspective view of the electrical connector of FIG. 1.
Figure 4:
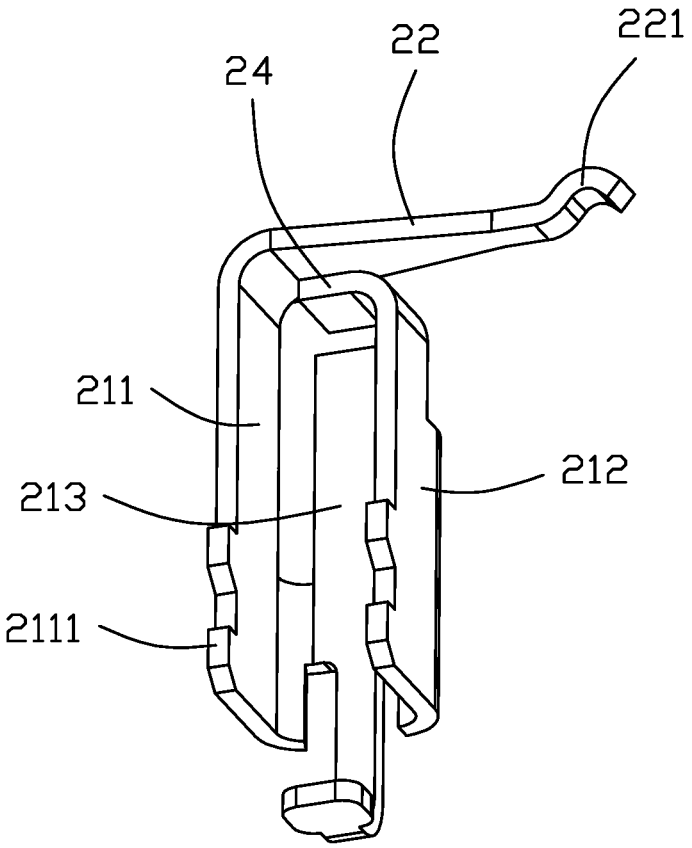
FIG. 4 is a perspective view of the contact of the electrical connector of FIG. 1.
Figure 5:
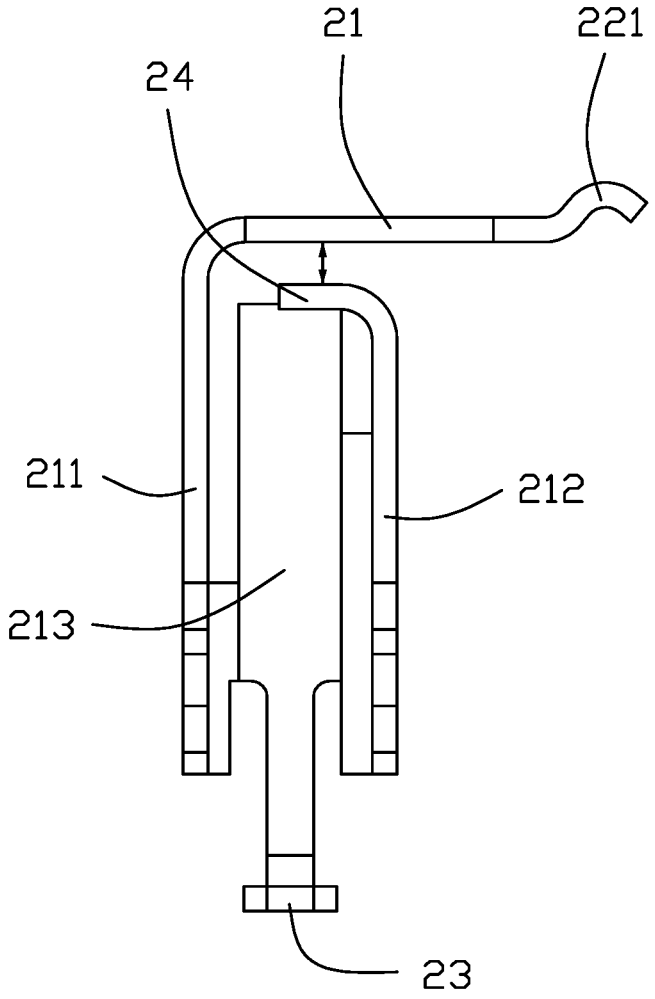
FIG. 5 is an elevation view of the contact of the electrical connector of FIG. 4.
Figure 6:
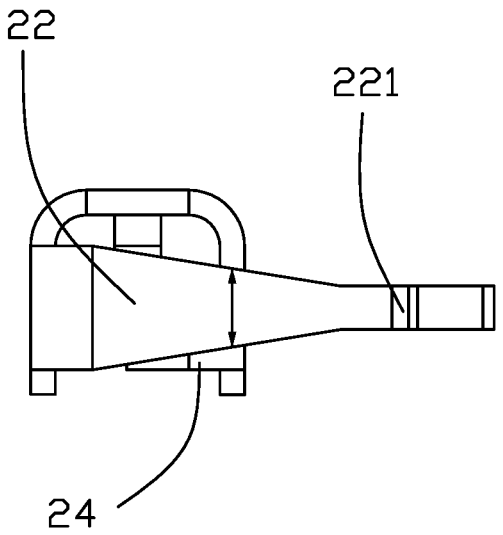
FIG. 6 is a top view of the contact of the electrical connector of FIG. 4.

Reference will now be made in detail to the embodiments of the present disclosure. The reference numerals are referred throughout to the different embodiments. The first embodiment is shown in FIGS. 1 to 6.

An electrical connector 100 for connecting a CPU (not shown) to a printed circuit board (not shown), includes an insulative housing 10 with a plurality of passageways 11 and a plurality of contacts 20 received within the corresponding passageways 11 and equipped with the corresponding solder balls 30, respectively. Notably, the resistance of each contact 20 is 85+/−15 ohm. Understandably, a width of the contact may affect both the resistance characteristic electrically and the contact force mechanically. In other words, increasing the width of the contact for lowering the impedance is not proper solution because of the relatively large contact force with the CPU.

The housing 10 includes an upper surface 101 and a lower surface 102 opposite to each other in the vertical direction, and the passageways 11 extend through both the upper surface 101 and the lower surface 102. The contact 20 includes an upstanding/retaining section 21, a downward deflectable spring arm 22 extending upwardly from the upper region of the upstanding section 21 and above the upper surface 101 with a contacting region 221 around the free end for contacting the CPU, and a mounting leg 23 extending from a lower region of the upstanding section 21 around the mounting surface 102. A stationary extension 24 extends from the upper region of the upstanding section 21 and beside the spring arm 22, and is located either slightly above or flush with the upper surface 101.

In this embodiment, the extension 24, which extends in a horizontal plane and toward a center of the corresponding passageway 11 in a top view so as to be located above and partially aligned with the corresponding solder ball in the vertical direction, is essentially located between the spring arm 22 and the upper surface 101. The spring arm 22 and the extension 24 are partially overlapped with each other in the vertical direction so as to result in the capacitance effect therebetween in the vertical direction. Notably, a parallel relation between the spring arm 22 and the extension 24 is preferred during using. In other words, in this embodiment the extension 24 extends in a horizontal plane so that the region of the spring arm 22 coupled with the extension 22 in the vertical direction also extends horizontally when the spring arm is pressed downwardly by the CPU. Alternately, if the extension 22 extends in an oblique plane at fifteen degrees, such coupling region of the spring arm extends also in another oblique plane at the fifteen degrees. In this embodiment, the spring arm 22 is gradually decreased from the root to the free end in width while the extension 24 essentially has the constant width thereof.

In this embodiment, the upstanding section 21 includes a first retaining section 211 and the second retaining section 212 with the middle section 213 linked therebetween. The spring arm 22 extends from the upper region of the first retaining section 211, the extension 24 extends from the upper region of the second retaining section 212, and the mounting leg 23 extends from the middle section 213. A pair of barbs 2111 are formed on two outer sides of the first retaining section 211 and the second retaining section 212. Notably, the first retaining section 211, the second retaining section 212 and the middle section 213 therebetween all extend in an upright manner.

The contacts 20 include signal contacts 20S and grounding contacts 20G surrounding the signal contacts 20S. A plurality of recesses 12 are formed in the lower surface 102 and located intimately beside the corresponding grounding contacts 20G to receive the corresponding solder pastes 40 therein. In practice, the solder ball 30 is pre-adhered to the mounting leg 23 and successively melted to be mounted to the corresponding conductive pad on the printed circuit board on which the housing 10 is seated. The melted solder ball 30 extends laterally to be linked with the neighboring solder paste 40 so as to improve the circumferential relation with the corresponding neighboring signal for avoiding electro-magnetic interference and eliminating resonance. Ideally, the combination of the grounding contacts 20G and the neighboring solder pastes 40 substantially surrounds the corresponding signal contacts 20G. In other embodiments, the solder paste 40 may be directly attached to the corresponding mounting leg 23 of the grounding contact 20G initially.

Figure 7:
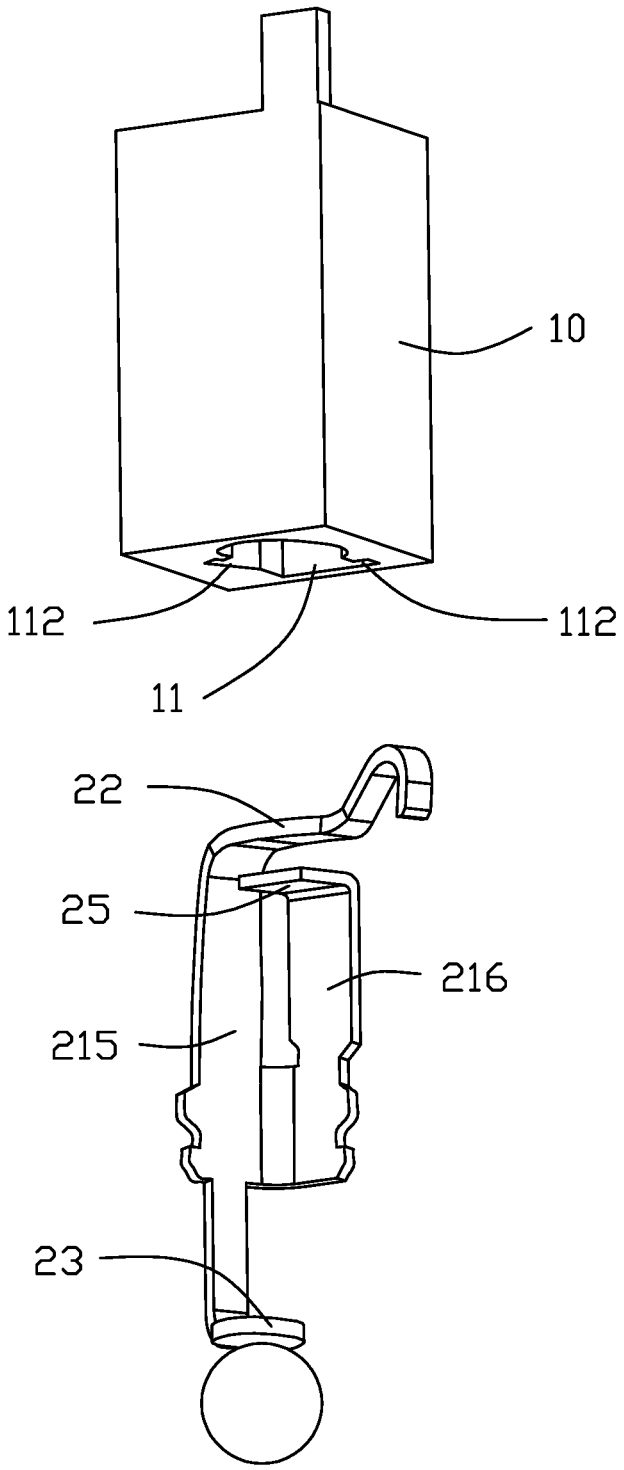
FIG. 7 is an exploded perspective view of a portion of an electrical connector according to a second embodiment of the invention.
Figure 8:
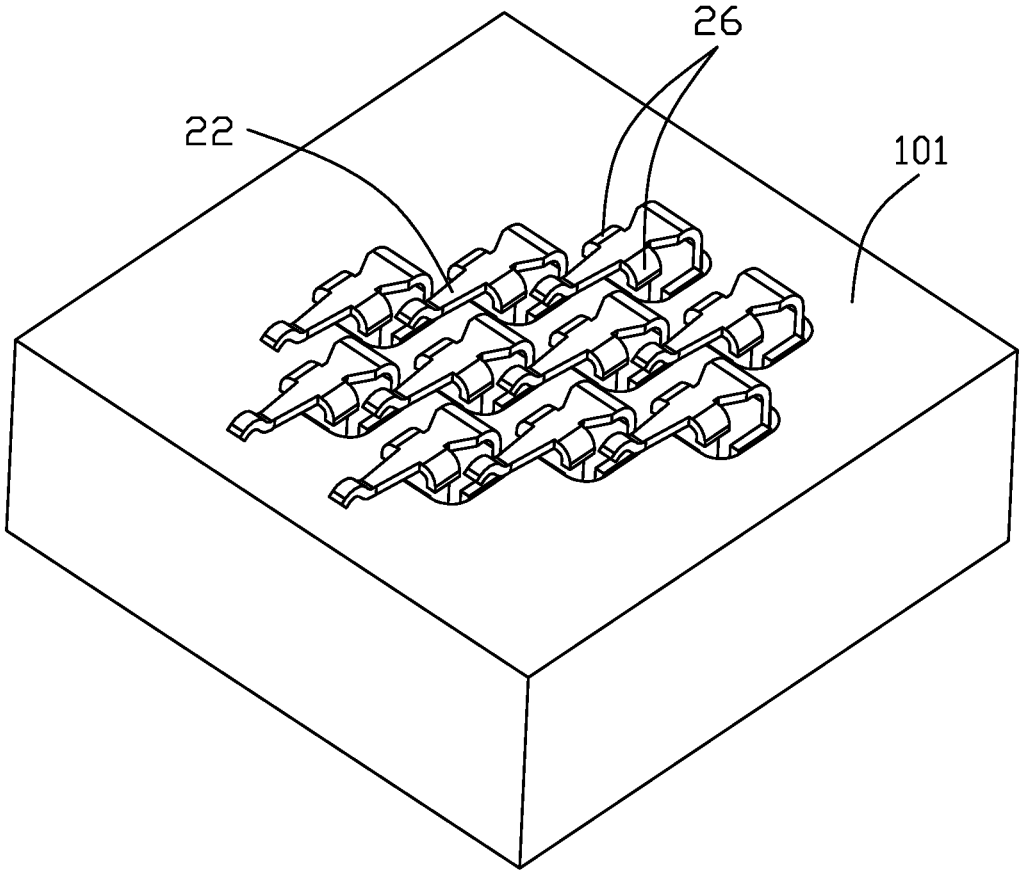
FIG. 8 is a perspective view of an electrical connector according to a third embodiment of the invention.
Figure 9:
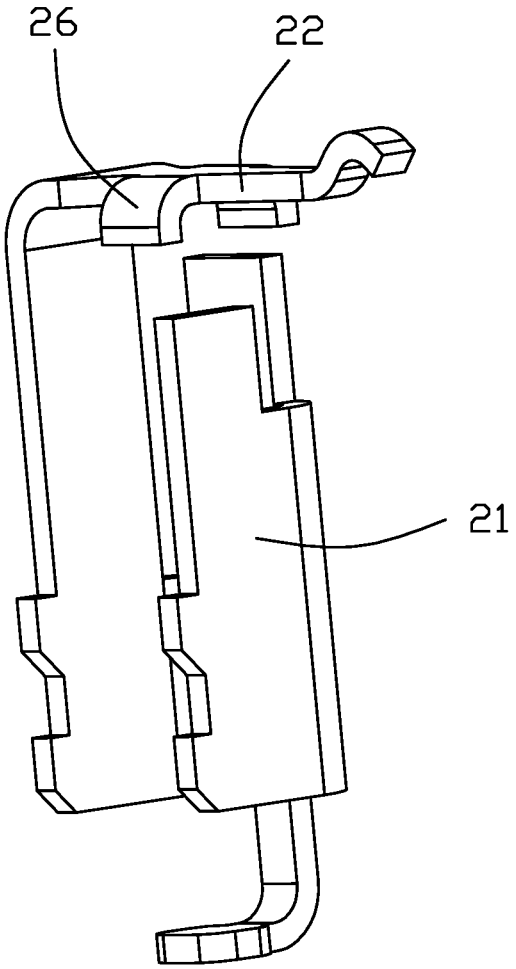
FIG. 9 is a perspective view of the contact of the electrical connector of FIG. 8.
Figure 10:
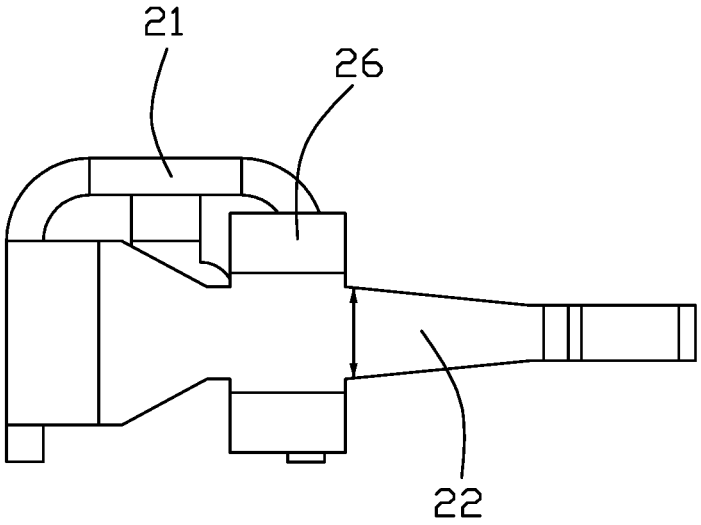
FIG. 10 is a top view of the contact of the electrical connector of FIG. 9.
Figure 11:
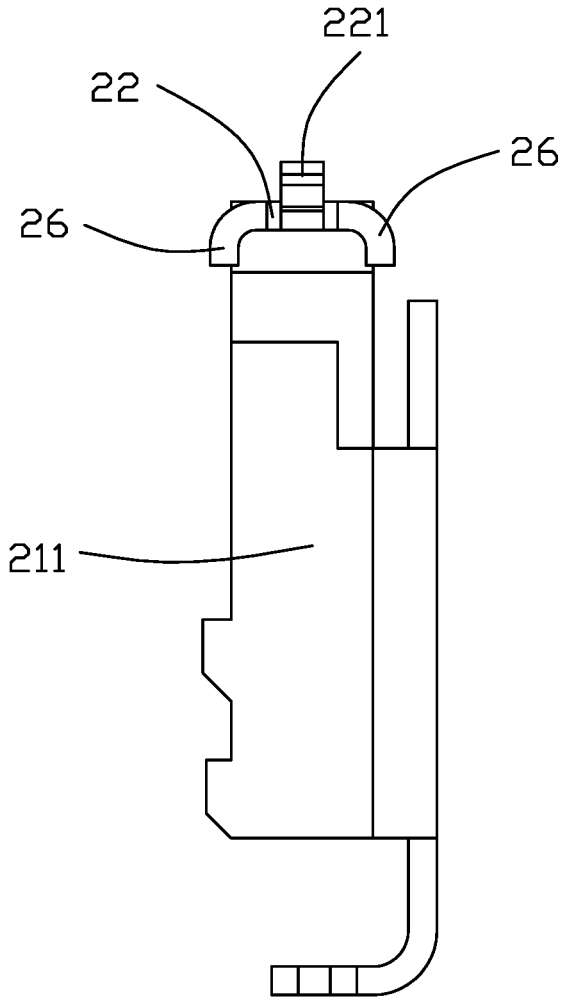
FIG. 11 is an elevation view of the contact of the electrical connector of FIG. 10.

FIG. 7 shows a second embodiment wherein the upstanding section includes the first retaining section 215 and the second retaining section 216 perpendicular to each other without the middle section therebetween. The spring arm 22 extends from the upper region of the first retaining section 215, the mounting leg 23 extends from the lower region of the first retaining section 215, and the extension 25 extends from the upper region of the second retaining section 216 wherein the first retaining section 215 and the second retaining section 216 are retained in the grooves 112. Notably, the extension 25 and the spring arm 22 are also partially overlapped with each other in the vertical direction for achieving the capacitance effect.

FIGS. 8-11 show a third embodiment wherein the extension section 26 includes a pair of pieces unitarily extending from two lateral sides of the spring arm 22, which may compensate the increasing impedance due to the reduced width of the spring arm 22. Notably, the extension 26 is essentially aligned with the upstanding section 21 when the spring arm 22 is downwardly pressed by the CPU for assuring the capacitance effect therebetween. Notably, the first embodiment and the second embodiment show the sufficient coupling between the extension and the spring arm with the relatively large area so as to lower the impedance while the third embodiment shows the intimate coupling with a relatively tiny distance between the extension and the upstanding section.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing forming opposite upper and lower surfaces in a vertical direction and including a plurality of passageways extending therethrough in the vertical direction;

a plurality of contacts retained in the corresponding passageways, respectively;

each of said contacts including:

an upstanding section retained to the housing, a spring arm extending from an upper region of the upstanding section above the upper surface with a contacting region, and a mounting leg extending from a lower region of the upstanding section around the lower surface; and a plurality of solder balls attached under the mounting legs, respectively; wherein each contact further includes an extension extending from the upper region of the upstanding section and beside the spring arm; wherein the extension is essentially located between the spring arm and the upper surface of the housing in the vertical direction, and the spring arm and the extension are at least partially overlapped with each other in the vertical direction; wherein the spring arm is downwardly deflectable while the extension is stationary.

2. The electrical connector as claimed in claim 1, wherein the upstanding section includes a first retaining section, a second retaining section spaced from the first retaining section in parallel, and a middle section linked therebetween, and the spring arm extends from an upper region of the first retaining section toward the second retaining section, the extension extends from an upper region of the second retaining section toward the first retaining section, and the mounting leg extends from the middle section.

3. The electrical connector as claimed in claim 2, wherein the first retaining section and the second retaining section are parallel to each other and commonly perpendicular to the middle section.

4. The electrical connector as claimed in claim 1, wherein the upstanding section includes a first retaining section and a second retaining section side by side linked with each other in a mutually perpendicular manner, and the spring arm extends from an upper region of the first retaining section, the mounting leg extends from a lower region of the first retaining section, and the extension extends from the second retaining section.

5. The electrical connector as claimed in claim 4, wherein the first retaining section is perpendicular to the second retaining section.

6. The electrical connector as claimed in claim 1, wherein the contacts include a plurality of grounding contacts and a plurality of signal contacts, the housing forms a plurality of recesses in the lower surface located beside the grounding contacts, to receive corresponding solder pastes, and the solder balls are linked with the solder pastes so as to surround the corresponding signal contacts.

7. The electrical connector as claimed in claim 1, wherein the extension extends in a horizontal plane and toward a center of the corresponding passageway so as to be located above and partially aligned with the corresponding solder ball in the vertical direction.

8. The electrical connector as claimed in claim 1, wherein a region of the spring arm coupled to the extension is parallel to the extension.

9. The electrical connector as claimed in claim 8, wherein said extension extends in a horizontal plane.

10. An electrical connector comprising:

an insulative housing forming opposite upper and lower surfaces in a vertical direction and including a plurality of passageways extending therethrough in the vertical direction;

a plurality of contacts retained in the corresponding passageways, respectively;

each of said contacts including:

an upstanding section retained to the housing, a downwardly deflectable spring arm extending from an upper region of the upstanding section above the upper surface with a contacting region, and a mounting leg extending from lower region of the upstanding section around the lower surface; and a plurality of solder balls attached under the mounting legs, respectively; wherein each contact further includes an extension extending downwardly from two opposite lateral outmost side edges of the spring arm toward the upstanding section; wherein the extension is essentially located between the spring arm and the upper surface of the housing in the vertical direction, and the extension is at least partially overlapped with the upstanding section in the vertical direction; wherein the upstanding section includes a first retaining section from which the spring arm extends, and a second retaining section opposite to the first retaining section with the corresponding passageway therebetween transversely, the extension downwardly extending toward and cooperating with the second retaining section to form capacitance effect therebetween.

11. The electrical connector as claimed in claim 10, wherein the contacts include a plurality of grounding contacts and a plurality of signal contacts, the housing forms a plurality of recessed in the lower surface located beside the grounding contacts, to receive corresponding solder pastes, and the solder balls are linked with the solder pastes so as to surround the corresponding signal contacts.

12. An electrical connector comprising:

an insulative housing forming opposite upper and lower surfaces in a vertical direction and including a plurality of passageways extending therethrough in the vertical direction;

a plurality of contacts retained in the corresponding passageways, respectively; each of said contacts including:

a retaining section, a spring arm extending from the retaining section in a cantilevered manner with a contacting region, a mounting leg extending from a lower region of the retaining section around the lower surface; and a plurality of solder balls attached under the mounting legs, respectively; wherein each contact further includes an extension extending from the retaining section and beside the spring arm; wherein the spring arm is downwardly deflectable while the extension is stationary; wherein the spring arm and the extension are at least partially overlapped with each other in the vertical direction to form capacitance effect.

13. The electrical connector as claimed in claim 12, wherein the spring arm extends from an upper region of the retaining section.

14. The electrical connector as claimed in claim 13, wherein the extension extends from the upper region of the retention section.

15. The electrical connector as claimed in claim 12, wherein the extension is essentially located between the spring arm and the upper surface of the housing in the vertical direction.

16. The electrical connector as claimed in claim 12, wherein the retaining section includes a first retaining section and a second retaining section side by side linked with each other, and the spring arm extends from an upper region of the first retaining section, the mounting leg extends from a lower region of the first retaining section, and the extension extends from the second retaining section.

17. The electrical connector as claimed in claim 16, wherein the first retaining section is perpendicular to the second retaining section.

18. The electrical connector as claimed in claim 12, wherein the contacts include a plurality of grounding contacts and a plurality of signal contacts, the housing forms a plurality of recesses in the lower surface located beside the grounding contacts, to receive corresponding solder pastes, and the solder balls are linked with the solder pastes so as to surround the corresponding signal contacts.

19. The electrical connector as claimed in claim 12, wherein the extension extends in a horizontal plane and toward a center of the corresponding passageway so as to be located above and partially aligned with the corresponding solder ball in the vertical direction.

20. The electrical connector as claimed in claim 12, wherein a region of the spring arm coupled to the extension is parallel to the extension.

* * * * *